US006686522B2

(12) United States Patent
Won et al.

(10) Patent No.: US 6,686,522 B2
(45) Date of Patent: Feb. 3, 2004

(54) MUSICAL INSTRUMENT WITH A BODY MADE OF POLYURETHANE FOAM

(75) Inventors: Seung Yeon Won, Incheon (KR); Sang Min Choi, Seoul (KR)

(73) Assignee: Shinko Corporation, Kyungki-do (KR)

( * ) Notice: Subject to any disclaimer, the term of this patent is extended or adjusted under 35 U.S.C. 154(b) by 78 days.

(21) Appl. No.: 09/886,155

(22) Filed: Jun. 22, 2001

(65) Prior Publication Data

US 2002/0033088 A1 Mar. 21, 2002

(51) Int. Cl.[7] ..... G10D 3/00
(52) U.S. Cl. ..... 84/291
(58) Field of Search ..... 84/291, 267, 290

(56) References Cited

U.S. PATENT DOCUMENTS

| | | | | |
|---|---|---|---|---|
| 3,738,675 A | * | 6/1973 | Hashimoto | 280/610 |
| 4,104,947 A | | 8/1978 | Oster | |
| 4,128,695 A | | 12/1978 | Kikuchi et al. | |
| 4,144,793 A | | 3/1979 | Soika et al. | |
| 4,145,947 A | * | 3/1979 | Joy | 84/123 |
| 4,188,850 A | | 2/1980 | Kaman, II | |
| 4,215,431 A | | 7/1980 | Nady | |
| 4,223,785 A | | 9/1980 | Jacques | |
| 4,313,362 A | | 2/1982 | Lieber | |
| 4,350,006 A | | 9/1982 | Okamoto et al. | |
| 4,364,990 A | | 12/1982 | Haines | |
| 4,407,982 A | * | 10/1983 | Elgie | 521/122 |
| 4,495,643 A | | 1/1985 | Orban | |
| 4,525,857 A | | 7/1985 | Orban | |
| 4,557,174 A | | 12/1985 | Gressett, Jr. | |
| 4,625,616 A | | 12/1986 | McVicker | |
| 4,719,952 A | | 1/1988 | Geronimo | |
| 4,770,929 A | | 9/1988 | Nobumasa et al. | |
| 4,823,670 A | | 4/1989 | Gherman et al. | |
| 4,909,510 A | | 3/1990 | Sahatjian | |
| 5,047,104 A | | 9/1991 | Preis et al. | |

(List continued on next page.)

*Primary Examiner*—Kimberly Lockett
(74) *Attorney, Agent, or Firm*—Burns, Doane, Swecker & Mathis, LLP

(57) ABSTRACT

The present invention relates to a musical instrument having its entire body portion manufactured by moulding the body with synthetic resin, in which the said musical instrument is an electric guitar which has the entire body 4 consisting of a base plate 1, a neck part 2 connected to the base plate 17 and a head part 3 connected to the end of the said neck part 2 to hang the strings, and in which the said entire body 4 is made of polyurethane foam having specific gravity in the range of 0.3 to 0.9. In the polyurethane foam additional porous particles sizing average diameter from 1 to 50 $\mu$m selected from a group comprising wood chips, silica or mixtures thereof may homogeneously be contained in an amount of 5 to 8% by weight. Furthermore, a piano, an exterior casing of amplifier and/or an exterior casing of electric guitar may also be made of polyurethane foam having specific gravity in the range of 0.3 to 0.9.

7 Claims, 7 Drawing Sheets

U.S. PATENT DOCUMENTS 5,143,750 A 9/1992 Yamagata et al.
5,146,833 A 9/1992 Lui
5,147,235 A 9/1992 Bamburak et al.
5,171,927 A 12/1992 Kubicki et al.
5,201,706 A 4/1993 Noguchi et al.
5,212,733 A 5/1993 DeVitt et al.
5,234,718 A 8/1993 Mino et al.
5,240,774 A 8/1993 Ogawa et al.
5,265,512 A 11/1993 Kubicki et al.
5,270,080 A 12/1993 Mino et al.
5,317,308 A 5/1994 Tribbey et al.
5,324,566 A 6/1994 Ogawa et al.
5,330,429 A 7/1994 Noguchi et al.
5,338,579 A 8/1994 Ogawa et al.
5,369,399 A 11/1994 Tribbey et al.
5,378,521 A 1/1995 Ogawa et al.
5,380,585 A 1/1995 Ogawa et al.
5,388,496 A 2/1995 Miller et al.
5,424,725 A 6/1995 Wandt et al.
5,435,839 A 7/1995 Ogawa
5,437,894 A 8/1995 Ogawa et al.
5,466,486 A 11/1995 Ogawa et al.
5,469,770 A 11/1995 Taylor
5,505,342 A 4/1996 Okamura et al.
5,538,762 A 7/1996 Ogawa et al.
5,545,255 A 8/1996 Ogawa
5,549,026 A * 8/1996 Gay, Jr. ..... 84/267
5,626,948 A 5/1997 Ferber et al.
5,645,633 A 7/1997 Ogawa
5,769,821 A 6/1998 Abrahamson et al.
5,770,640 A 6/1998 Ogawa
5,801,319 A 9/1998 Hebestreit et al.
5,815,395 A * 9/1998 Hart et al. ..... 700/110
5,816,395 A 10/1998 Dougherty
5,849,369 A 12/1998 Ogawa
5,859,377 A 1/1999 Mackey et al.
5,876,806 A 3/1999 Ogawa
5,883,319 A 3/1999 Hebestreit et al.
5,905,219 A 5/1999 Westheimer
5,907,013 A 5/1999 Ogawa
5,907,113 A 5/1999 Hebestreit et al.
5,911,168 A 6/1999 Enserink
5,920,023 A 7/1999 Ravagni et al.
5,929,362 A 7/1999 Oteyza
5,971,870 A 10/1999 Sullivan et al.
5,973,420 A 10/1999 Kaiserman et al.
5,998,541 A 12/1999 Ogawa
6,008,440 A 12/1999 Yamada
6,013,331 A 1/2000 Ogawa
6,041,836 A 3/2000 Murai
6,042,984 A 3/2000 Taniguchi
6,060,123 A 5/2000 Ogawa
6,063,438 A 5/2000 Ogawa
6,080,922 A 6/2000 Dimbath
6,100,458 A 8/2000 Carrington et al.
6,137,045 A 10/2000 Short et al.
6,139,965 A 10/2000 Murai
6,152,835 A 11/2000 Sullivan et al.
6,157,929 A 12/2000 Zamiska et al.
6,169,240 B1 1/2001 Suzuki
6,169,241 B1 1/2001 Shimizu
6,183,512 B1 2/2001 Howanec, Jr. et al.
6,359,208 B1 * 3/2002 Farnell, Jr. ..... 84/726

* cited by examiner

MUSICAL INSTRUMENT WITH A BODY MADE OF POLYURETHANE FOAM

FIELD OF INVENTION

The present invention relates to a musical instrument and/or acoustic apparatus body part of which is to be made of polyurethane foam, more particularly to the musical instrument and/or acoustic apparatus, such as an electric guitar, a piano, an amplifier, whose casing or entire body is to be made of polyurethane foam, which has good property of moulding and processing and does not result in crack and twist.

According to the present invention, the musical instrument and/or acoustic apparatus is provided by moulding the entire body part of instrument as being one body with polyurethane foam, therefore, resulting in a period of process shorter than the prior arts which have used woods, and saving the process cost, while maintaining the quality of sounds coming from those musical instrument and/or acoustic apparatus in at least same level as those of the prior art.

PRIOR ART

The various kinds of musical instruments, such as electric guitar or piano, has customarily been made of woods which should have been selected through a rigid inspection, and therefore, was expensive. In order to manufacture the electric guitar, especially the body part of electric guitar with wood in the conventional process, the woods should be processed by baking/drying the woods in a drying furnace; sizing the wood into a predetermined size; gluing the woods together into the predetermined shape of electric guitar; and processing the body of electric guitar to provide a pocket with which the required electric devices are equipped, and to have a predetermined curve of outline, which have been complicated and long-term processes.

Moreover, in order to provide the wooden electric guitar with the optimal acoustic property, the respective conditions for each process must be varied depending on the corresponding woods, and much time and labor are required for shaving and milling wood into the desired shape of guitar. Nevertheless, since most of woods had its own defects, which is not appropriate to be used as wood source, a high percent of processed woods have been disposed. It has been a representative problem in the field of manufacturing wooden guitar.

In order to overcome this problem, some approaches have been proposed, especially by manufacturing the guitar with injection moulding of plastic resin, such as ABS, into the plate body part; and gluing the wooden neck part with the plate body part to completing the entire body part of guitar.

However, according to the above process, since only plate body part of the entire body part of guitar was moulded with resin, and neck part should be made of wood, and thereafter bounded together, those multi-step process and their costs have not been reduced in a significant scale. Furthermore, the specific gravity of resin, such as ABS resin, which was recently used, was too high to be used for manufacture of electric guitar. Moreover, after completion of manufacture steps, some phenomenon such as twist or crack was incurred on the body of guitar. Therefore, it became another problem that the acoustic quality of sound coming from the guitar manufactured by the recent prior art.

Therefore, an object of the present invention is to solve the aforementioned problems, and provide a musical instrument and/or acoustic apparatus, such as an electric guitar, a piano, an amplifier, whose casing or entire body is to be made of polyurethane foam, which has good property of moulding and processing and does not result in crack and twist.

Another object of the present invention is to provide the musical instrument and/or acoustic apparatus by moulding the entire body part of instrument as being one body with polyurethane foam, which can result in a shorten period of process shorter than those of prior arts which have used woods, and the save of process cost, while maintaining the quality of sounds coming from those musical instrument and/or acoustic apparatus in at least same level as those of the prior art.

Still another object of the present invention is to provide the casing of musical instruments and/or amplifier for electric guitar.

The present inventors have extensively and intensively studied for overcoming the problems of prior art, and found out that the above-mentioned objects can be accomplished by using polyurethane foam in stead of the plastic resin and moulding each plate body part and neck part of guitar into one-body as being the entire body part, with creating no crack or twist in the body even after the process. Furthermore, it can result in a shorten period of process shorter than those of prior arts which have used woods, and the save of process cost, while maintaining the quality of sounds coming from those musical instrument and/or acoustic apparatus in at least same level as those of the prior art.

SUMMARY OF INVENTION

The present invention provides a musical instrument having its entire body portion manufactured by moulding the body with synthetic resin.

According to a preferred embodiment of the present invention, a musical instrument having its entire body portion manufactured by moulding the body with synthetic resin, in which the said musical instrument is an electric guitar which has the entire body consisting of a base plate, a neck part connected to the base plate, and a head part connected to the end of the said neck part to hang the strings, and in which the said entire body is made of polyurethane foam having specific gravity in the range of 0.3 to 0.9.

According to the second embodiment of the present invention, an electric guitar having its entire body portion manufactured by moulding the body with synthetic resin is provided, in which the additional porous particles selected from a group comprising wood chips, silica or mixtures thereof are homogeneously contained in the polyurethane foam which forms the entire body portion of the electric guitar.

According to the preferable embodiment of the present invention, the amount of particles to be able to be admixed in the polyurethane foam is 5 to 8% by weight based on total weight of polyurethane foam. The average diameter of the porous particles may range from 1 to 50 $\mu$m.

According to another preferred embodiment of the present invention, the said musical instrument is a piano, and in which the interior part and/or exterior part consisting the entire body of piano is made of polyurethane foam having specific gravity in the range of 0.3 to 0.9.

According to still another embodiment of the present invention, an exterior casing of amplifier for electric guitar is provided, in which the said exterior casing is made of polyurethane foam having specific gravity in the range of 0.3 to 0.9.

According to another embodiment of the present invention, an exterior casing of electric guitar for enclosing and/or protecting is provided, in which the said exterior casing is made of polyurethane foam having specific gravity in the range of 0.3 to 0.9.

BRIEF DESCRIPTION OF DRAWINGS

Hereinafter, the brief description of drawings attached to the specification is provided.

DETAILED DESCRIPTION OF INVENTION

Figure 1:
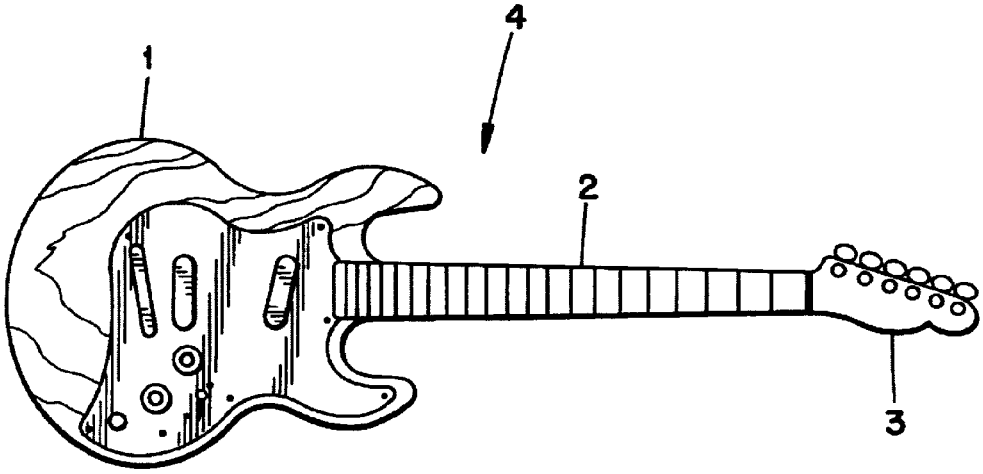
FIG. 1 depicts a schematic view of the electric guitar manufactured according to a preferable exercise of the present invention; and Each

A musical instrument according to the present invention has its entire body portion manufactured by moulding the body with synthetic resin, in which the said musical instrument is an electric guitar which has the entire body 4 consisting of a base plate 1, a neck part 2 connected to the base plate 1, and a head part 3 connected to the end of the said neck part 2 to hang the strings, and in which the said entire body 4 is made of polyurethane foam having specific gravity in the range of 0.3 to 0.9.

The electric guitar according to the invention may contain additional porous particles selected from a group comprising wood chips, silica or mixtures thereof, which are homogeneously contained in the polyurethane foam which forms the entire body portion of the electric guitar. However, in aspect of the cost of material and the rigidness, talc, plaster, clay, etc. may also be used.

Total amount of particles to be admixed in the polyurethane foam is preferably 5 to 8% by weight based on total weight of polyurethane foam, and the average diameter of the porous particles ranges preferably from 1 to 50 $\mu$m.

The present invention can also be applied to the area of another musical instrument such as piano, an exterior casing of amplifier for electric guitar, and an exterior casing of electric guitar for enclosing and/or protecting, In the manufacture of the electric guitar according to the present invention, if the specific gravity of polyurethane foam is less than 0.3, the moulding process cannot be carried out in a successful manner; and if the specific gravity of polyurethane foam is higher than 0.9, the weight of guitar may become too heavy and the acoustic quality may be reduced.

Method for manufacture of the entire body part of an electric guitar according to the present invention is as follows.

Firstly, a rigid resin of polyurethane polyol containing the foaming agent may be mixed with polyisocyanate in an appropriate molar such as 1:1. At this point, the porous particles as aforementioned may be incorporated into the polyol resin in order to improve the resonance effect of the electric guitar.

The said mixture is to be introduced into the mould which has a shape of the desired electric guitar. After sealing the enterance of mould, the mould may be heated, or disposed under the ambient temperature for a predetermined period such as for 10 to 20 minute, in order for the enclosures to be hardened by foaming reaction into the completion of moulding.

When out from the mould, the entire body of the electric guitar made of polyurethane foam may be obtained. At this time, a pocket part, to which the electronic devices necessary for the electric guitar may be equipped may be formed during the moulding process. However, if necessary, it may be formed after completion of moulding process. In this case, the entire body part may be moulded as one body, that is, the neck part 2, head part 3 and plate body part 1 may be moulded as one body. However, it is not excluded from the scope of the invention that the neck part 2, head part 3 and plate body part 1 may be moulded as being the separate pieces, and thereafter bonded.

Hereinafter, the invention will be described by way of Examples without limiting the scope and spirit of the invention.

EXAMPLES

Example 1.

Shape formation of Main Body of Electric Guitar

The appropriate amount of talc and 13 weight % of multipore particles(Silica: F.C.G., mean diameter: 30 $\mu$m) were added into hard polyurethane polyol resin containing blowing agents. Polyisocyanate was added into the mixture in the mole ratio of 1:1. After agitation of the mixture, 1.4 kg of the mixture was inserted into 2.9 liter of a mold having the shape of electric guitar and the inlet of the mold was sealed. After storing the mold at room temperature for 15 minutes, the mold was removed to produce a main body of electric guitar made of polyurethane foam having the specific gravity of 0.5.

The produced electric guitar had good sound performance, and low occurrence of distortion or cracks after shape formation.

Example 2.

Property Tests of Polyurethane Foam Samples

1. Comparison of the consuming time for process and production costs

The consuming time for process and production costs between the electric guitar of the invention and the electric guitar made of wood of the prior art are compared.

TABLE 1

Comparison of processes for producing the electric guitar between the prior art and the invention

| Process No. | Prior Process | Prior Art | Consuming Time (day) | Present Invention | Consuming Time (day) |
|---|---|---|---|---|---|
| #1 | Selection of wood | O | 1 | Shape forming process (O) | 1 |
| #2 | Processing of the shape of main body | O | 1 | | |
| #3 | Surface smoothing of main body wood | O | 1 | | |
| #4 | Processing of the shape of neck | O | 1 | | |
| #5 | Surface smoothing of the neck wood | O | 1 | | |
| #6 | First painting | O | 1 | O | 1 |
| #7 | Drilling the first painting | O | 1 | O | 1 |

TABLE 1-continued

Comparison of processes for producing the electric guitar between the prior art and the invention

| Process No. | Prior Process | Prior Art | Consuming Time (day) | Present Invention | Consuming Time (day) |
|---|---|---|---|---|---|
| #8 | Second painting | O | 1 | X | X |
| #9 | Drilling the second painting | O | 1 | X | X |
| #10 | Third painting | O | 1 | O | 1 |
| #11 | Drilling the third painting | O | 1 | O | 1 |
| #12 | Shining | O | 1 | O | 1 |
| #13 | Assembling | O | 1 | O | 1 |
| #14 | Inspection | O | 1 | O | 1 |
| #15 | Packaging | O | 1 | O | 1 |
| Total consuming process | | | 15 | | 9 |

In Table 1, O represents an essential process and X represents an unnecessary process.

In the above processes, total consuming time during #1 to #15 processes is about 15 days in the prior art, but about 9 days in the present invention. Therefore, the present invention reduces the consuming time for process to the extent of about 40%. In conclusion, the present invention reduces about 60% in the costs and about 40% in the consuming time for process relative to the prior art.

2. Comparison of sound

Testing Conditions:

i) Sound tests on each main body and neck made of wood or polyurethane were performed under the same conditions.

ii) Pickup: 3-single pickup(made by Sungjin Industry) was used.

iii) String: D'Addario guitar string made in U.S.A. was used.

iv) Tuning: Tuning was performed by using Guitar Tuner.

Sample: one electric guitar made of wood and one electric guitar made of polyurethane.

Testing machine: Audio precision: system 1

Results: Table 2

Figure 2A:
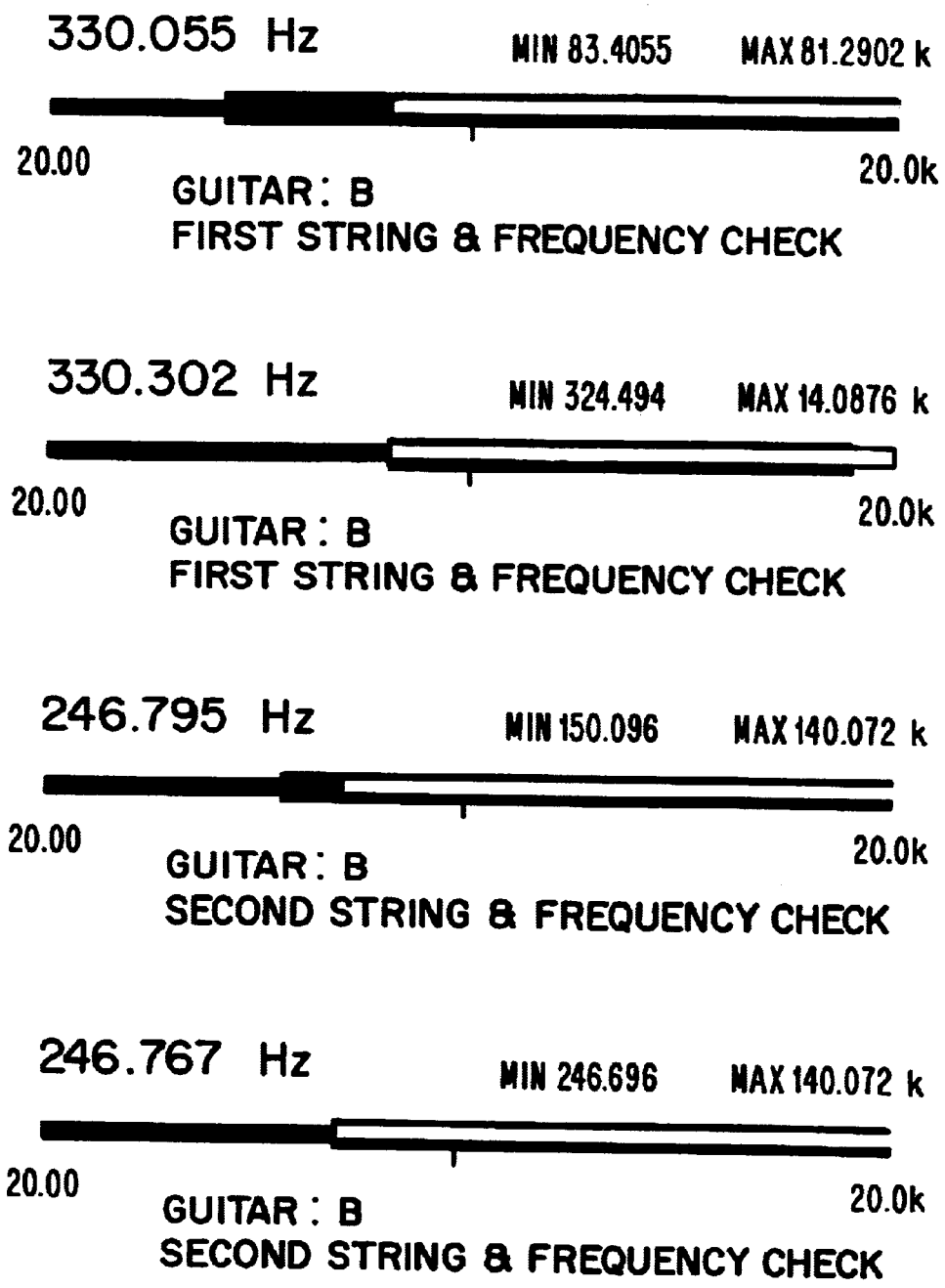
FIG. 2*a* to FIG. 2*f* show the results (HZ) from an acoustic test between the strings of guitars of the present invention and prior art, depending on various range of wave lengths of acoustic sound.
Figure 2B:
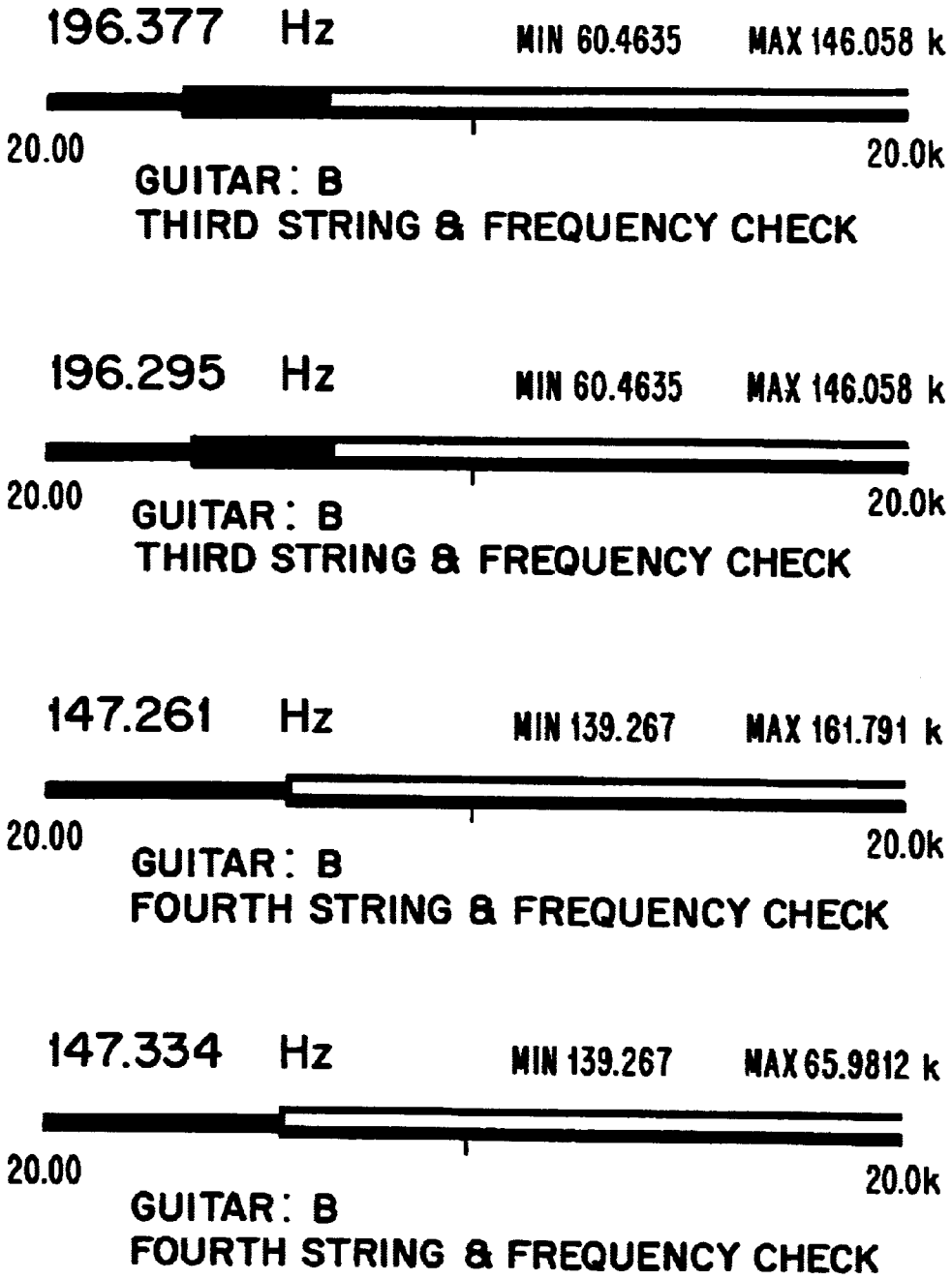
Figure 2C:
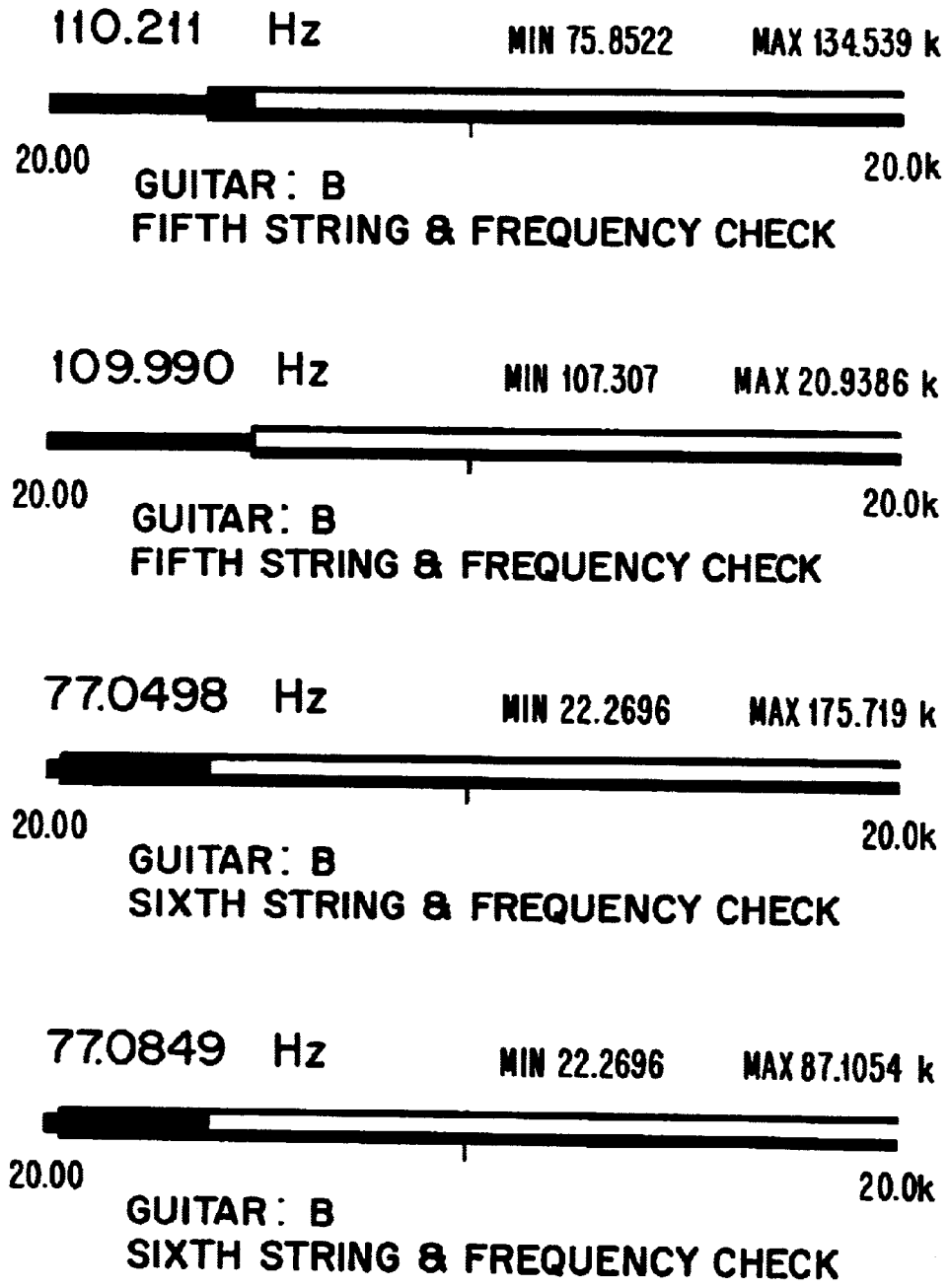
Figure 2D:
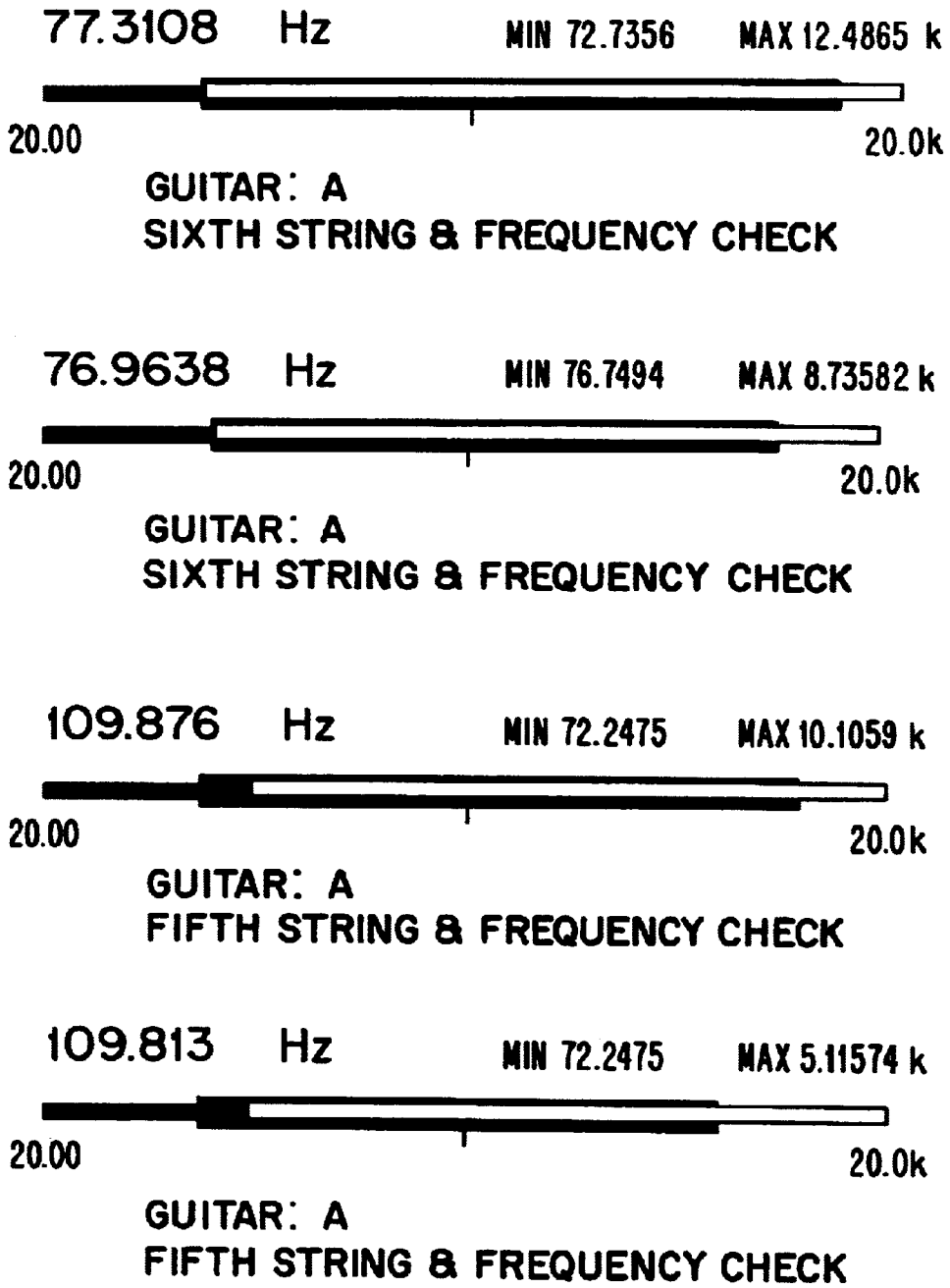
Figure 2E:
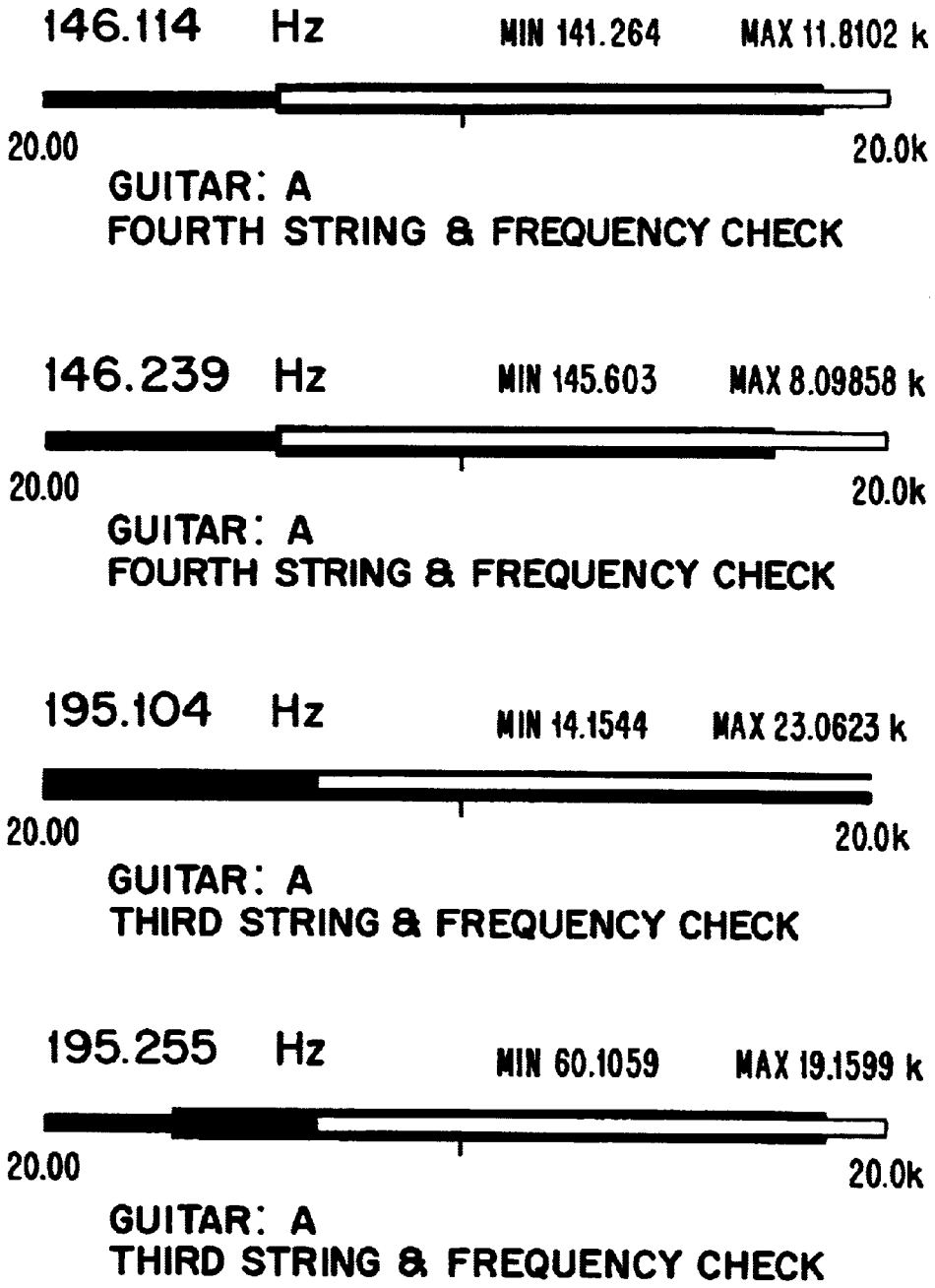
Figure 2F:
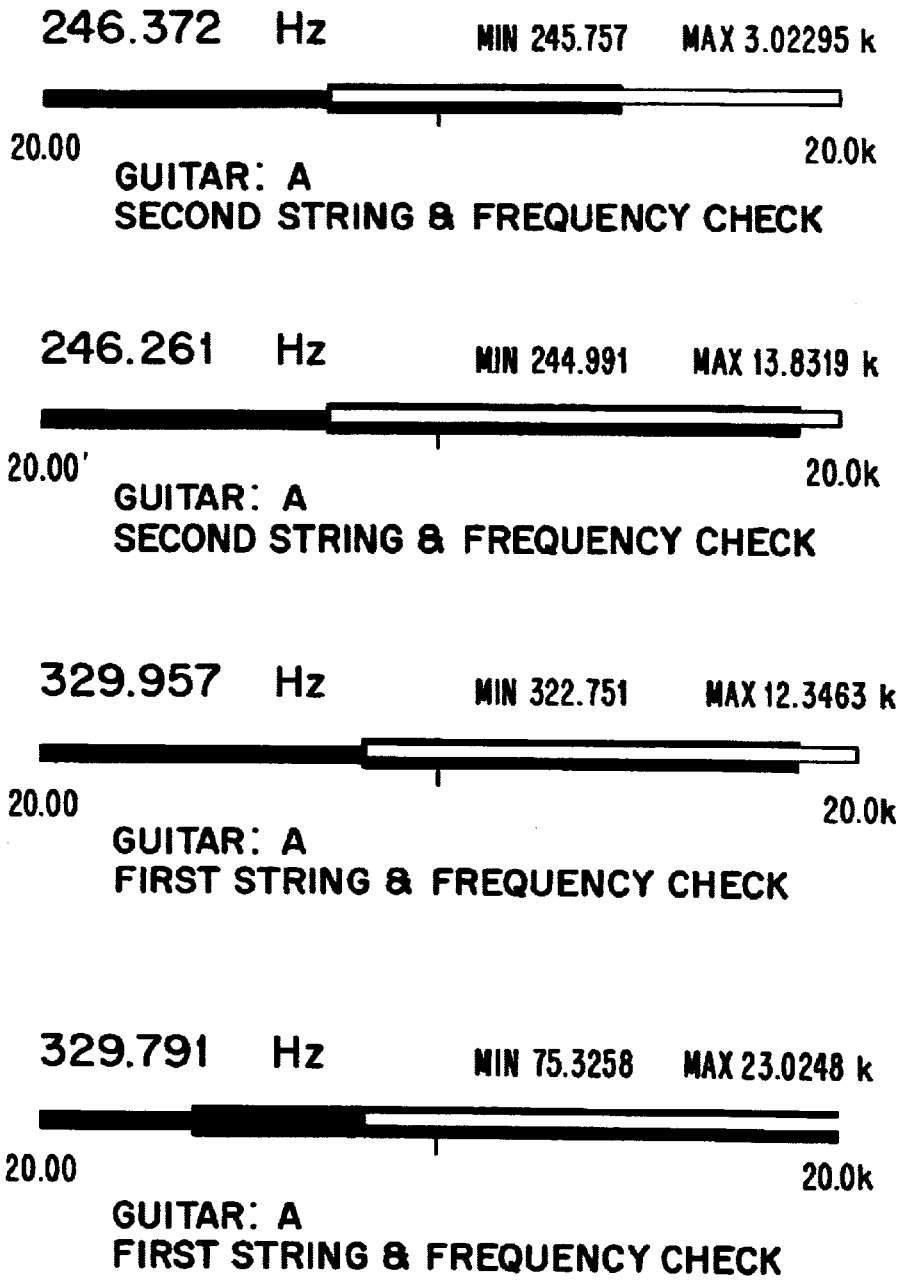

As the results, there was no difference between electric guitars made by the prior art and by the present inventions since their sound results were nearly identical in all sound ranges. The results of sound/frequency test are shown in FIG. 2, in which the electric guitar made of wood is represented by guitar A and the electric guitar made of polyurethane is represented by guitar B.

TABLE 2

Comparison of frequency in each string between electric guitars made of wood and polyurethane

| | Frequency (Hz) | | | | | |
|---|---|---|---|---|---|---|
| | First string | Second string | Third string | Fourth string | Fifth string | Sixth String |
| Wood-1 | 329.957 | 246.372 | 195.104 | 146.114 | 109.876 | 77.3108 |
| Wood-2 | 329.791 | 246.261 | 195.255 | 146.239 | 109.813 | 76.9638 |
| Polyurethane-1 | 330.055 | 246.795 | 196.377 | 147.261 | 110.211 | 77.0498 |
| Polyurethane-2 | 330.302 | 246.767 | 196.295 | 147.334 | 109.990 | 77.0849 |

3. Comparison of flexural stress

Testing conditions:

i) After preparing samples by cutting the electric guitars made of wood and polyurethane, the flexural stress of each sample was measured.

ii) Samples had the same size.

Sample:

i) Size of testing sample made of wood: 5 cm×20 cm×2 cm (width×length×height)

ii) Size of testing sample made of polyurethane:

a. Polyurethane sample having the specific gravity of 0.4 Size=5 cm×20 cm×2 cm (width×length×height)

b. Polyurethane sample having the specific gravity of 0.6 Size=5 cm×20 cm×2 cm (width×length×height)

c. Polyurethane sample having the specific gravity of 0.8 Size=5 cm×20 cm×2 cm (width×length×height)

Testing machine; Universal test machine made by Oriental Company

The results of flexural stress of each sample are listed in Table 3.

TABLE 3

| | Maximum load (KGF) | Maximum stress (kg/cm$^2$) |
|---|---|---|
| Wood (Bass Wood) | 117.00 | 11.73 |
| Polyurethane (0.4 specific gravity) | 143.50 | 15.65 |
| Polyurethane (0.6 specific gravity) | 266.40 | 28.94 |
| Polyurethane (0.8 specific gravity) | 390.20 | 42.82 |

As the results, the flexural stress of polyurethane sample was higher than that of wood sample (Bass Wood). In conclusion, these results represent that samples of the invention is stronger than that of the prior art. Therefore, the above polyurethane samples are appropriate for the electric guitar.

4. Distortion test

Testing conditions:

i) Distortion test was repeatedly performed at 80° C. for 1 hour then −30° C. for 1 hour.

ii) Samples had the same size.

Sample:

iii) Size of testing sample made of wood: 15 cm×30 cm×4 cm (width×length×height)

iv) Size of testing sample made of polyurethane:

a. Polyurethane foam sample having the specific gravity of 0.4 Size=15 cm×30 cm×4 cm (width×length×height)

b. Polyurethane foam sample having the specific gravity of 0.6 Size=15 cm×3 cm×4 cm (width×length×height)

c. Polyurethane foam sample having the specific gravity of 0.8 Size=15 cm×30 cm×4 cm (width×length×height)

The results of distortion of each sample under hot and cool conditions are listed in Table 4.

TABLE 4

| | After fifth repeat | After seventh repeat | Note |
|---|---|---|---|
| Wood (Bass Wood) | Some distortion | Serious distortion | |
| Polyurethane (0.4 specific gravity) | None | None | After storing samples for 24 hours at room temperature, |
| Polyurethane (0.6 specific gravity) | None | None | |

TABLE 4-continued

| | After fifth repeat | After seventh repeat | Note |
|---|---|---|---|
| Polyurethane (0.8 specific gravity) | None | None | distortion test was performed. |

As the results, the distortion of the electric guitar made of polyurethane foam was lower than that of the electric guitar made of wood (Bass Wood). Therefore, these results represent that the above polyurethane foam samples are appropriate for the electric guitar.

The musical instruments of the invention, in particular electric guitar and piano consisting of main body made of polyurethane foam have good shape formation, good sound performance, and low occurrence of distortion or cracks after shape formation. In addition, since their production processes are reduced, they can be made with lower costs.

Especially, if the polyurethane foam consisting of main body in musical instruments contains multipore particles, the musical instruments will have more improved sound performance.

What is claimed is:

1. An electrical guitar, comprising:

a body including a base plate, a neck part connected to the base plate, and a head part connected to an end of the neck part to hang strings, said entire body including the base plate, the neck part and the head part being made of polyurethane foam having specific gravity in the range of 0.3 to 0.9.

2. The electric guitar according to claim 1, wherein porous particles selected from a group comprising wood chips, silica or mixtures thereof are homogeneously contained in the polyurethane foam which forms the entire body of the electric guitar.

3. The electric guitar according to claim 2, wherein the amount of particles to be admixed in the polyurethane foam is 5 to 8% by weight based on total weight of polyurethane foam.

4. The electric guitar according to claim 1, characterized in that the average diameter of the porous particles ranges from 1 to 50 $\mu$m.

5. A piano, comprising:

an interior and exterior body wherein the interior and exterior body of the piano is made of polyurethane foam having specific gravity in the range of 0.3 to 0.9.

6. An exterior casing of amplifier for electric guitar, wherein said entire exterior casing is made of polyurethane foam having specific gravity in the range of 0.3 to 0.9.

7. An exterior casing of electric guitar, wherein said entire exterior casing is made of polyurethane foam having specific gravity in the rang eof 0.3 to 0.9.

* * * * *